US009784516B2

(12) United States Patent
Murphy, II et al.

(10) Patent No.: US 9,784,516 B2
(45) Date of Patent: Oct. 10, 2017

(54) FIREARM HANDGRIP WITH INTERGRATED SAFETY LOCK SYSTEM

(71) Applicants: William Lewis Murphy, II, Orlando, FL (US); Robert Vail Harvey, Orlando, FL (US)

(72) Inventors: William Lewis Murphy, II, Orlando, FL (US); Robert Vail Harvey, Orlando, FL (US)

(73) Assignee: Gun Guardian, LLC, Orlando, FL (US)

( * ) Notice: Subject to any disclaimer, the term of this patent is extended or adjusted under 35 U.S.C. 154(b) by 0 days.

(21) Appl. No.: 15/261,279

(22) Filed: Sep. 9, 2016

(65) Prior Publication Data

US 2017/0108301 A1 Apr. 20, 2017

Related U.S. Application Data

(63) Continuation-in-part of application No. 14/885,394, filed on Oct. 16, 2015, now abandoned.

(51) Int. Cl.

| | |
|---|---|
| ***F41A 17/20*** | (2006.01) |
| ***F41A 17/06*** | (2006.01) |
| ***F41C 23/16*** | (2006.01) |

(52) U.S. Cl.

CPC ..... *F41A 17/066* (2013.01); *F41A 17/20* (2013.01); *F41C 23/16* (2013.01)

(58) Field of Classification Search

CPC ..... F41A 17/20; F41A 17/22; F41A 17/24; F41A 17/26; F41A 17/28; F41A 17/06; F41A 17/063; F41A 17/066

See application file for complete search history.

(56) References Cited

U.S. PATENT DOCUMENTS

| | | | | |
|---|---|---|---|---|
| 2,115,041 | A | 4/1938 | Obregon | |
| 4,775,176 | A | 10/1988 | Ikeda | |
| 6,185,852 | B1 * | 2/2001 | Whalen | F41A 17/066 42/70.11 |
| 6,240,669 | B1 | 6/2001 | Spaniel et al. | |
| 2014/0150316 | A1 * | 6/2014 | Acarreta | F41A 17/02 42/70.06 |

FOREIGN PATENT DOCUMENTS

| | | |
|---|---|---|
| EP | 1058081 | 12/2000 |
| WO | WO 2010/008644 | * 1/2010 |

* cited by examiner

*Primary Examiner* — Stephen M Johnson
(74) *Attorney, Agent, or Firm* — Jason T. Daniel, Esq.; Daniel Law Offices, P.A.

(57) ABSTRACT

A firearm handgrip with integrated safety lock system includes a handgrip having a plurality of connectors, a generally hollow interior space and an aperture, An elongated retractable plate is positioned within the aperture and is connected to a plate alignment unit located within the interior space of the handgrip. The plate transitions between an extended position and a retracted position. In the extended position, the plate physically engages the firearm's integrated safety mechanism to maintain the same in the "safe" position. The system further includes a biometric authentication system, an electromechanical latch and an internal controller.

20 Claims, 11 Drawing Sheets

FIREARM HANDGRIP WITH INTERGRATED SAFETY LOCK SYSTEM

CROSS-REFERENCE TO RELATED APPLICATIONS

This application claims the benefit of U.S. application Ser. No. 14/885,394 filed on Oct. 16, 2015, the contents of which are incorporated herein by reference.

TECHNICAL FIELD

The present invention relates generally to firearm safety devices, and more particularly to a firearm handgrip with an integrated safety mechanism.

BACKGROUND

The statements in this section merely provide background information related to the present disclosure and may not constitute prior art.

As any responsible firearm owner will attest, firearms should always remain locked when they are not in use, so as to prevent an accidental discharge of the same and/or to prevent access by an unauthorized individual. As such, there are many known types of commercially available firearm locking mechanisms such as trigger guards and/or trigger locks, for example which can be secured along or about the firearm trigger to prevent access to the same.

Although useful in their inception, these devices suffer from several drawbacks. For example, because these locking mechanisms are externally mounted, it is not uncommon for one or more pieces of the lock to become lost when the same is not secured onto the weapon. Additionally, it is not uncommon for users to secure the lock onto the weapon incorrectly, thereby causing a situation where unauthorized access can occur. Finally, the time required to correctly secure and/or physically remove the external lock may be unacceptable in emergency situations where the user needs immediate access to the weapon.

For these reasons, many individuals rely solely on the integrated safety mechanism of the firearm to act as the only means for securing the weapon in an inoperable state. To this end, FIG. 1 illustrates one embodiment of a conventional firearm, in this instance a long gun, that is useful for understanding the inventive concepts disclosed herein. As shown, the firearm 1 typically includes a buttstock 2, a handguard 3, an elongated gun barrel 4 and a receiver 5 that houses a magazine 6, a trigger assembly 7, a hand grip 8 and an integrated selector/safety 9.

To this end, the safety mechanism 9 requires the user to physically rotate the mechanical lever to the "safe" position, wherein the internal components of the receiver prevent the weapon from firing even if the trigger 5 is engaged. Although not shown, another common safety mechanism replaces the illustrated lever with a push-button which must be depressed by the user to engage or disengage the safety mechanism.

Accordingly, it would be beneficial to provide a firearm handgrip with an integrated safety lock that can be permanently mounted onto the weapon in order to secure the same in a locked state, so as to not suffer from the drawbacks described above.

SUMMARY OF THE INVENTION

The present invention is directed to a handgrip lock system for use on a firearm having a safety mechanism. One embodiment of the present invention can include a handgrip having a plurality of connectors for engaging a firearm so as to replace the manufacturer-supplied grip. The handgrip of the present invention can include a generally hollow interior space and an aperture that is located beneath the location of the integrated firearm safety of the firearm to which the handgrip is to be secured. An elongated retractable plate is provided having a top surface that extends out of the aperture, and a bottom surface that is connected to a plate alignment unit located within the interior space of the handgrip.

The retractable plate can transition between an extended position and a retracted position. In the extended position, the plate can physically engage the firearm's integrated safety mechanism, so as to maintain the same in the "safe" position. Conversely, in the retracted position, the plate will not be in contact with the firearm's integrated safety mechanism, thereby allowing the same to be switched from the "safe" position to the "fire" position.

Another embodiment of the present invention can include a user interface which can be selectively engaged to transition the plate between the extended and retracted position. The user interface can include a biometric authentication system that can provide access to the firearm upon verification of a user identity.

In yet another embodiment, the present invention can include an electromechanical locking system that is controlled by an internal controller. The system can further include a communication unit that can send system information to an external device.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

For the purposes of this description, a firearm has a longitudinal axis extending from the butt stock to the tip of the weapon's barrel. The firearm is defined as being upright when held in a position such that a trigger area is beneath the barrel of the firearm. Although described and illustrated for use with a long gun having a rotatable safety/selector mechanism, this is for illustrative purposes only. To this end, the inventive concepts disclosed herein can be utilized on any type of firearm having a grip and a safety mechanism. With particular regard to firearms having the push-button style safety mechanisms, the system 10 can function in the exact manner described below, however the extended plate can function to cover the entirety of the safety release button, thereby preventing access to the same until the plate is in the retracted position.

Figure 8A:
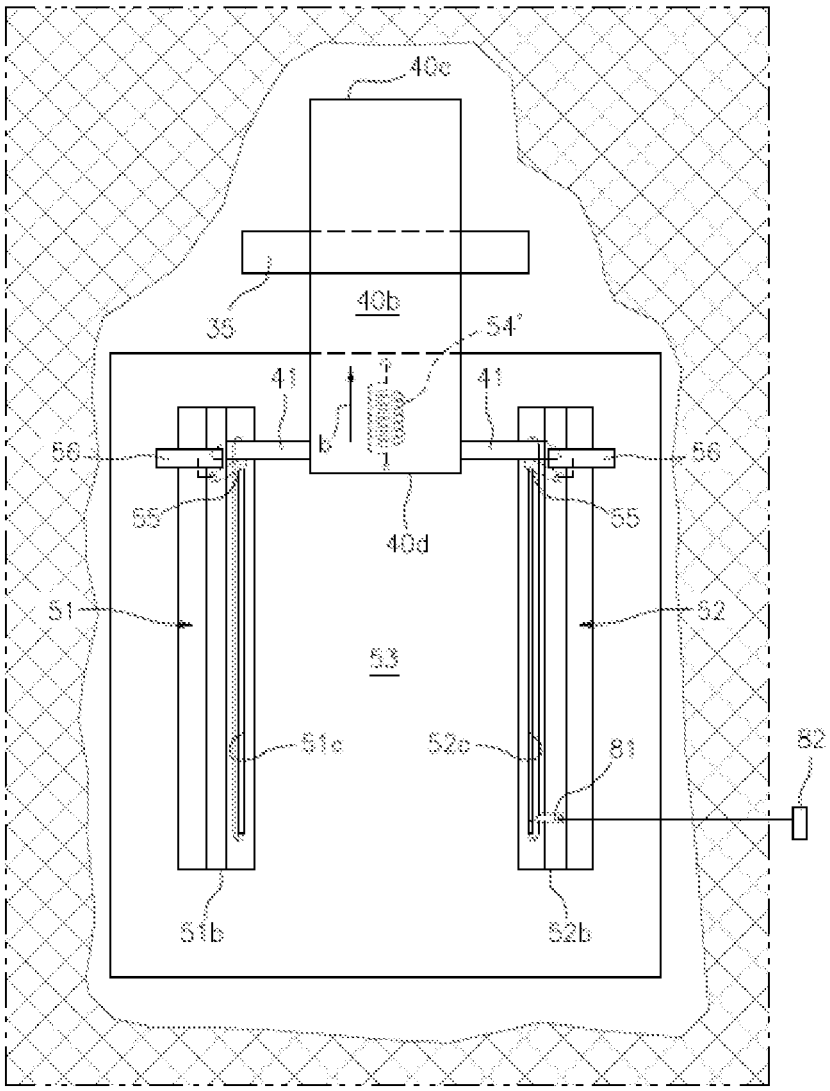
FIG. 8A is a perspective view of the plate alignment unit of the firearm handgrip with integrated safety lock system, in accordance with another embodiment of the invention.
Figure 8B:
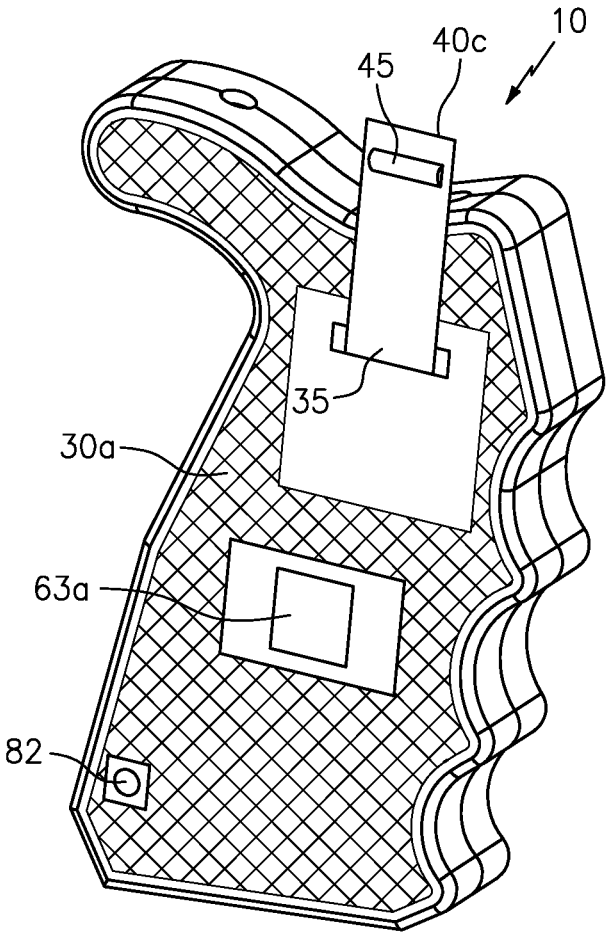
FIG. 8B is a side view of the firearm handgrip with integrated safety lock system, in accordance with another embodiment of the invention.

Moreover, although illustrated for use on a firearm having the safety mechanism located along the left hand side of the weapon, this is for ease of illustration, as other embodiments are contemplated wherein the system is manufactured with the components arranged so as to accommodate weapons that are constructed for left handed users wherein the safety mechanism is located on the right side of the weapon (See FIG. 8B).

FIGS. 2-8B illustrate various embodiments of a firearm handgrip with integrated safety lock system 10 that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 2.

Figure 1:
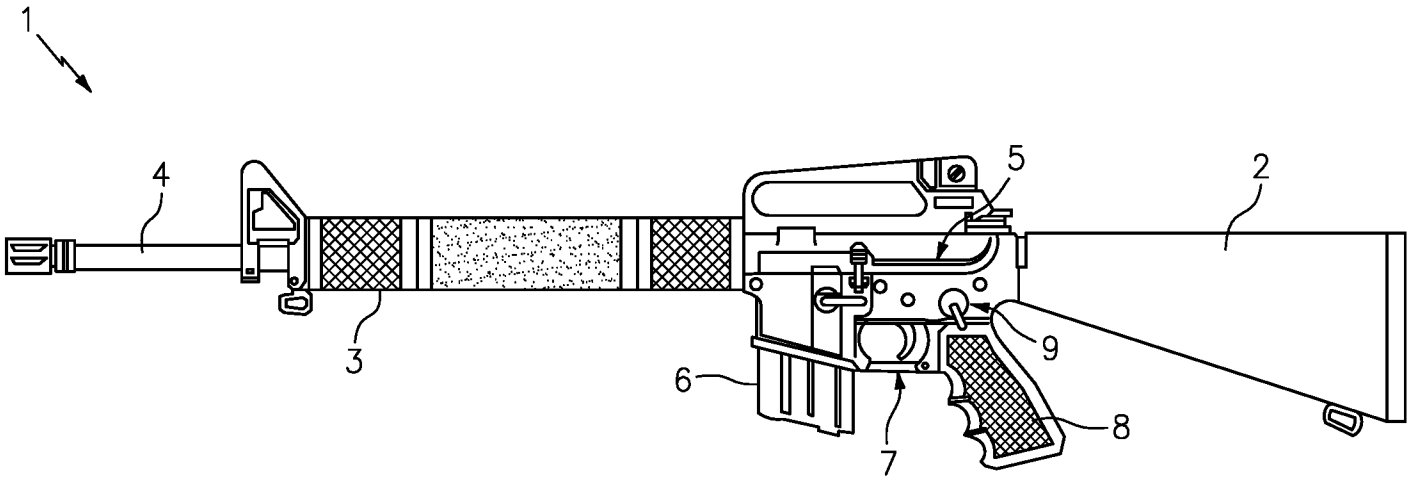
FIG. 1 (Background Art)
FIG. 1 is a side view of a firearm in accordance with the background art that is useful for understanding the inventive concepts disclosed herein.
Figure 2:
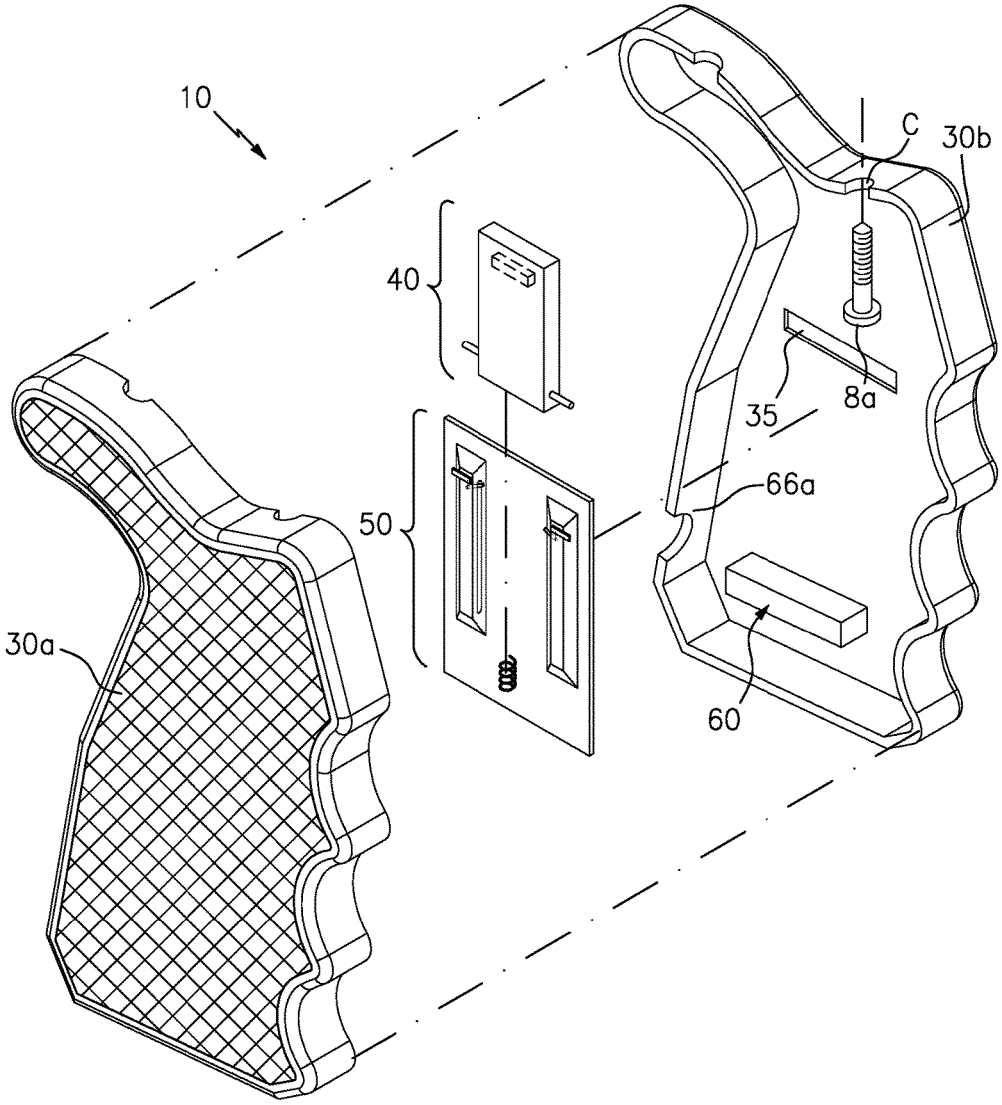
FIG. 2 is an exploded parts view of the firearm handgrip with integrated safety lock system, in accordance with one embodiment of the invention.

FIG. 2 is an exploded parts view of the system components. As shown, the system 10 can include, essentially, a hand grip 30, a retractable plate 40, a plate alignment unit 50 and an internal controller 60.

Figure 3:
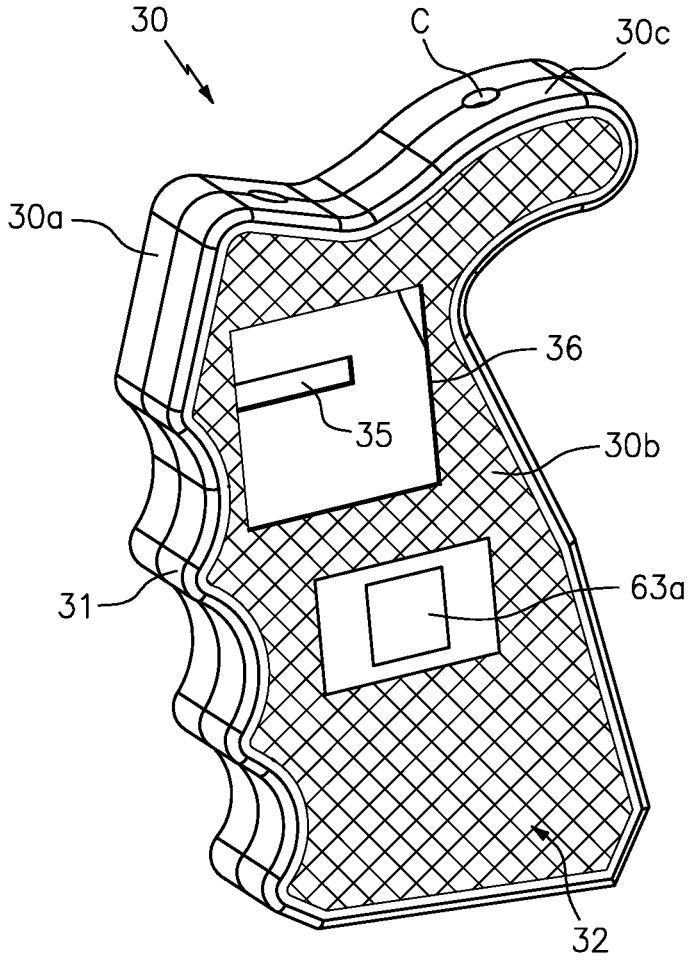
FIG. 3 is a perspective view of the handgrip portion of the firearm handgrip with integrated safety lock system, in accordance with one embodiment of the invention.

As shown in FIG. 3, the assembled hand grip 30 can include an elongated generally hollow and tubular-shaped member having a left side portion 30*a*, a right side portion 30*b* and a top end 30*c*. The exterior facing portions of the hand grip can include any number of gripping elements such as various finger ridges 31 and/or rough texturing 32, to facilitate use. An aperture 35 can be disposed along one or both sides of the grip, at a location beneath the safety mechanism of the weapon for which the grip is to be connected. To this end, the grip can include a contoured section 36 along the location of the aperture 35, so as to allow the below described retractable plate to move up and down.

The hand grip 30 can function to replace the manufacturer-supplied grip 8, and can therefore include any number of connectors C such as through holes and/or threaded openings, for example, that can be disposed along the grip 30 at locations identical to those found on the stock grip 8. As such, the top end of the grip 30*c* can be secured onto the firearm utilizing the manufacturer-supplied hardware 8*a* via the complementary connectors located on the firearm.

As described herein, the hand grip 30 can be constructed from any number of rigid durable materials such as plastic and/or various metals, for example. Moreover, the grip can be constructed to include any number of different shapes and sizes, so as to be compatible with virtually any type of firearm. Although described as a replacement grip, those of skill in the art will recognize that the grip 30 can also be incorporated into the new construction of a firearm, so as to impart the inventive concepts disclosed herein as a factory component.

Figure 4:
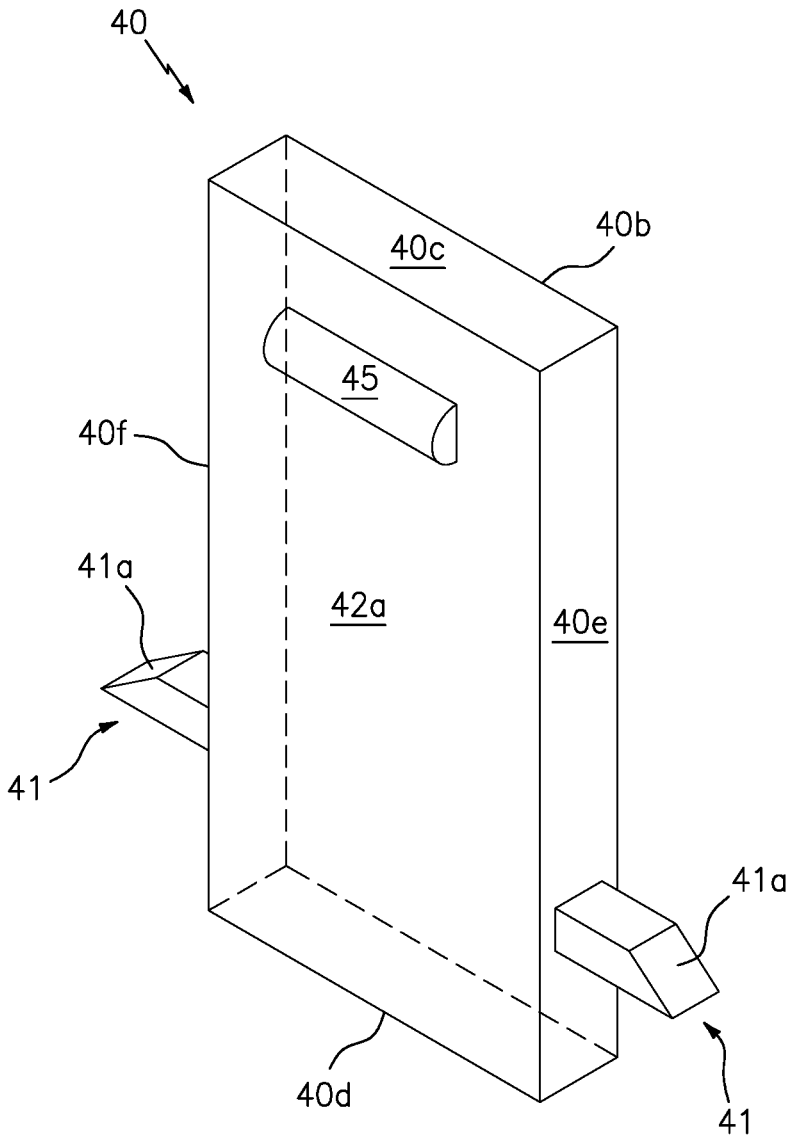
FIG. 4 is a perspective view of the retractable plate of the firearm handgrip with integrated safety lock system, in accordance with one embodiment of the invention.

FIG. 4 illustrates one embodiment of the retractable plate 40 which can be positioned within the aperture 35 and controlled by the below described plate alignment unit 50 and internal controller 60. In the present embodiment, the retractable plate 40 can include an elongated, generally planar member having an outside facing surface 40*a*, an inside facing surface 40*b*, a top end 40*c*, a bottom end 40*d* and a pair of opposing sides 40*e* and 40*f*. As shown, a pair of protruding strikers 41 can extend outward from the opposing sides 40*d* and 40*e*. Although the strikers can include any number of different shapes and sizes, in the preferred embodiment, each of the strikers can include an angled top surface/leading edge 41*a*.

In various embodiments, a thumb grip 45 in the form of an indentation or protrusion can be positioned along the outside facing surface of the plate 40*a* at a location adjacent to the top end 40*c*. As will be described below, the thumb grip can function to receive an upward force from a user's thumb when transitioning the plate into the extended position. In either instance, the plate 40 can preferably be constructed from a hardened metal such as steel, for example, however any number of other durable impact resistant materials having an extremely high bending/breaking point are also contemplated.

Figure 5A:
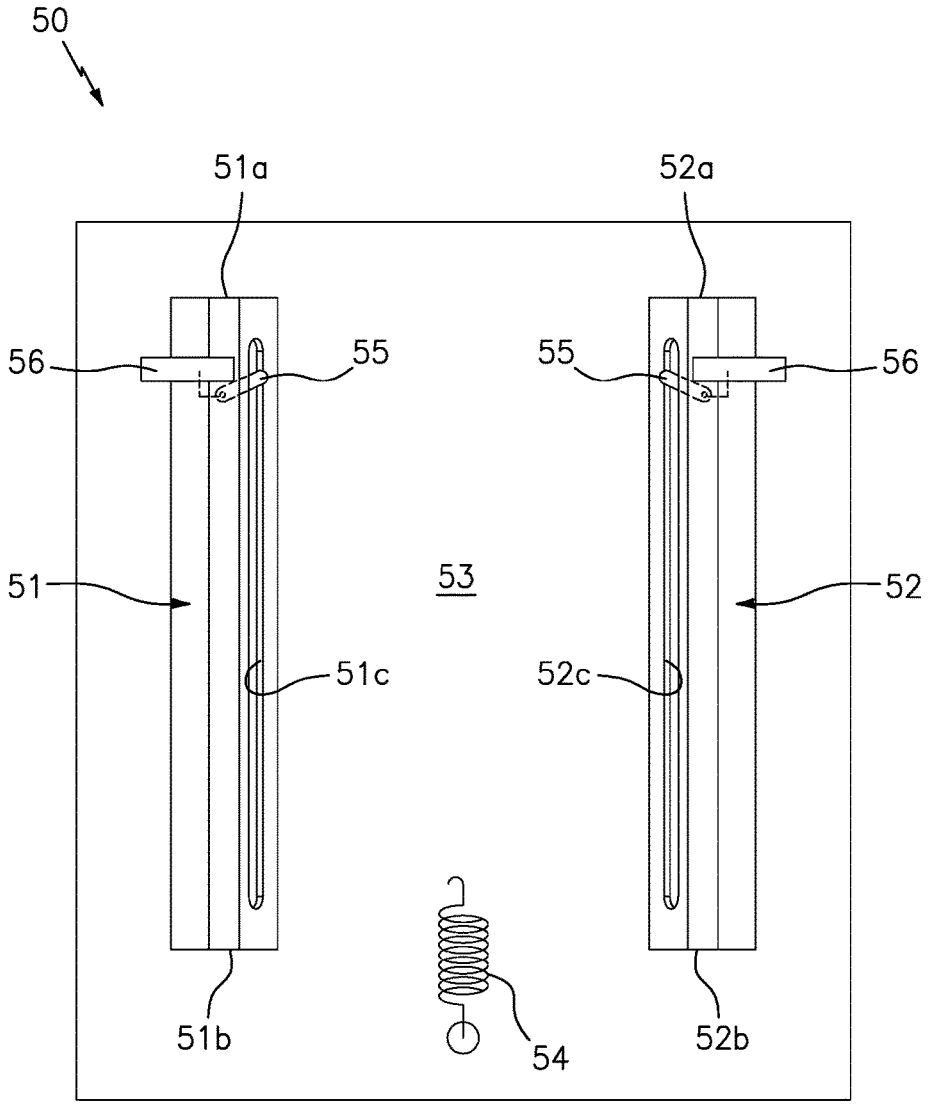
FIG. 5A is a perspective view of the plate alignment unit of the firearm handgrip with integrated safety lock system, in accordance with one embodiment of the invention.
Figure 5B:
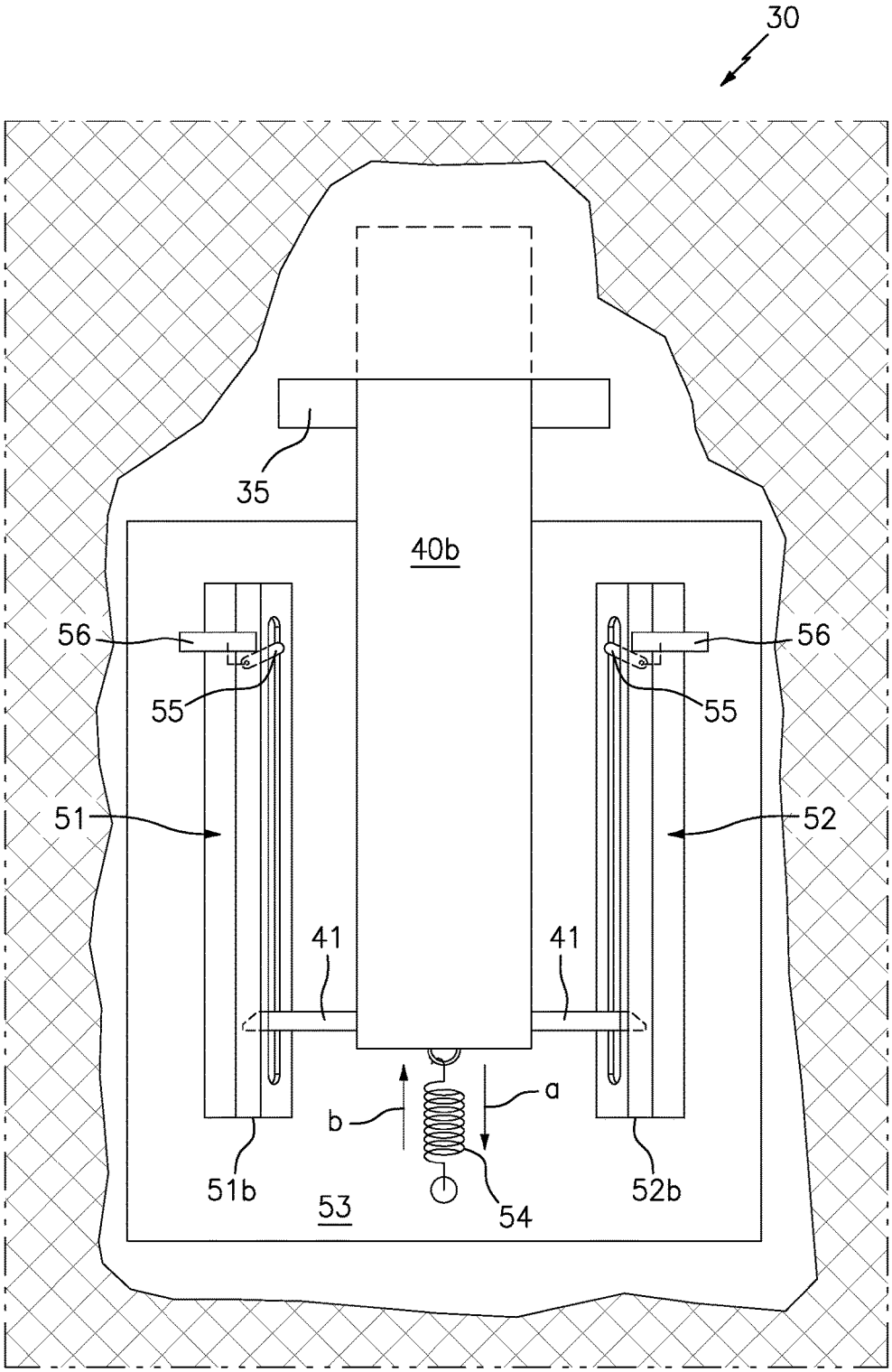
FIG. 5B is a perspective view of the plate and the plate alignment unit of the firearm handgrip with integrated safety lock system, in accordance with one embodiment of the invention.

FIGS. 5A and 5B illustrate one embodiment of the plate alignment unit 50, which can be secured within the grip 30 at a location beneath the aperture 35. The plate alignment unit can function to guide and secure the retractable plate 40 in the extended and retracted positions. As shown, the unit 50 can include a plate guide that is preferably in the form of pair of opposing channels 51 and 52, each including a top end 51*a*-52*a*, a bottom end 51*b*-52*b*, and an opening 51*c*-52*c* extending therebetween for receiving the strikers 41 of the plate 40. As shown best in FIG. 5B, each of the channels can be disposed along a generally flat mounting panel 53 which can be secured directly onto the left or right portions of the grip 30 via any number of known manufacturing techniques such as welds, adhesives and/or hardware such as fasteners, for example. Of course, the plate guide can also include any number of other components capable of engaging the plate 40 and allowing the same to move linearly between the extended and retracted positions.

A retention member such as a spring 54, for example, can be secured along the mounting panel and can engage the bottom end of the plate 40 so as to pull (see arrow a) the plate toward the bottom end of each of the channels 51*b* and 52*b*, respectively. In this regard, the retention member functions to automatically position the retractable plate 40 in the retracted position wherein the thumb grip is positioned adjacent to the aperture 35 along the outside facing portion of the grip 30 until the same is manually extended by a user (see arrow b).

A pair of latches 55 can be disposed along the top end of each of the channels 51*a* and 52*a*, respectively. The latches can function to automatically and mechanically engage the strikers 41 when the same reach the top end of the channels thereby locking the plate 40 in the fully extended position. As noted above, in the preferred embodiment, the top portion of each striker can include an angled end 41*a*. As such, when a user manually pulls up on the plate, the same will slide upwards until the strikers make contact with the latches 55. At this time, the angled ends 41*a* can open the internal locking mechanism of the latch so as to allow the strikers to pass therethrough. Once the strikers are pulled above the locking mechanism the same will return to the fully extended position.

As only the top ends of the strikers 41*a* are angled, no amount of downward force will cause the internal locking mechanism of the latch to open. Therefore, in the preferred embodiment, each of the latches can include or be connected to an electromechanical component 56, such as a linear actuator, for example, that can be in communication with the below described internal controller 60, so as to physically transition each latch to an unlocked position that releases the strikers, upon receiving a command therefrom.

The basic design and operation of mechanical latches and strikers are well known in the art and are also described in U.S. Pat. No. 4,775,176, to Ikeda, the contents of which are incorporated herein by reference. Of course, any number of commercially available locking mechanisms are also contemplated.

As described herein, each of the channels 51 and 52, and the mounting panel 53 can preferably be constructed from a hardened metal such as steel, for example, however any number of other durable impact resistant materials having an extremely high bending/breaking point are also contemplated. Moreover, other embodiments are contemplated wherein the alignment unit omits the use of the mounting panel 53. In such embodiments, the illustrated components can be secured directly onto the handle grip in the same locations and using the same methodology as that described above.

Figure 6:
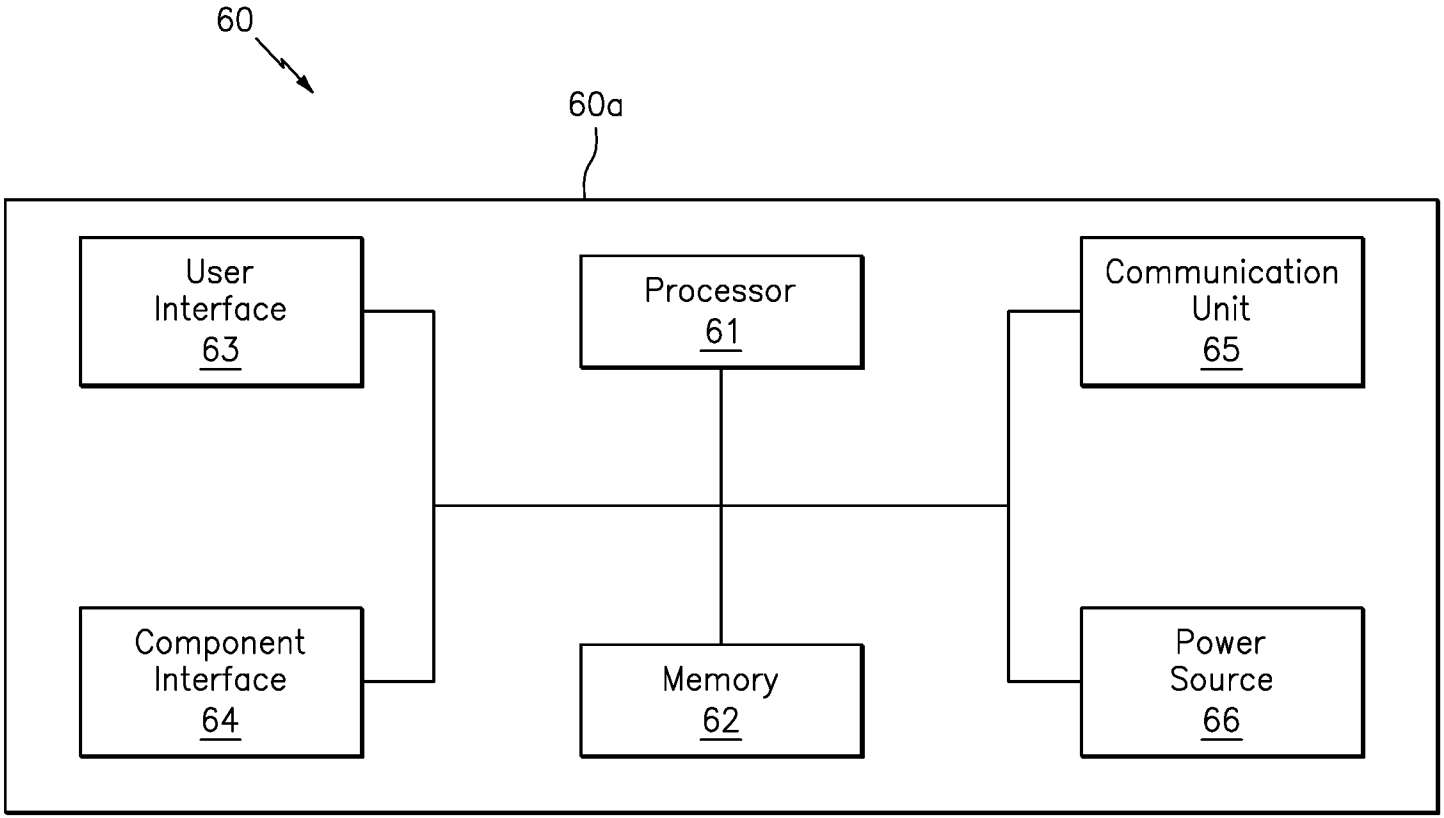
FIG. 6 is a simplified block diagram of the internal controller of the firearm handgrip with integrated safety lock system, in accordance with one embodiment of the invention.

FIG. 6 illustrates one embodiment of the internal controller 60 which can function to control an operation of the latches upon receiving a command from a user. In one embodiment, the internal controller can include an outer shell/body 60*a* having a processor 61 that is conventionally connected to an internal memory 62, a user interface 63, an internal component interface unit 64, an optional communication unit 65 and/or a power source 66.

Although illustrated as separate elements, those of skill in the art will recognize that one or more system components may comprise, or include one or more printed circuit boards (PCB) containing any number of integrated circuit or circuits for completing the activities described herein. The CPU may be one or more integrated circuits having firmware for causing the circuitry to complete the activities described herein. Of course, any number of other analog and/or digital components capable of performing the below described functionality can be provided in place of, or in conjunction with the below described controller elements.

The main body 60*a* can include any number of different shapes and sizes, and can be constructed from any number of different materials suitable for encompassing each of the controller elements. In one preferred embodiment, the main body 60*a* can be constructed from lightweight injection molded plastic having a plurality of internal connectors (not shown) for securely housing each of the device elements. Of course, any number of other known construction materials such as PVC and composites, for example, are also contemplated.

The processor/CPU 61 can act to execute program code stored in the memory 62 in order to allow the device to perform the functionality described herein. Processors are extremely well known in the art, therefore no further description will be provided.

Memory 62 can act to store operating instructions in the form of program code for the processor 61 to execute. Although illustrated in FIG. 6 as a single component, memory 62 can include one or more physical memory devices such as, for example, local memory and/or one or more bulk storage devices. As used herein, local memory can refer to random access memory or other non-persistent memory device(s) generally used during actual execution of program code, whereas a bulk storage device can be implemented as a persistent data storage device such as a hard drive, for example. Additionally, memory 62 can also include one or more cache memories that provide temporary storage of at least some program code in order to reduce the number of times program code must be retrieved from the bulk storage device during execution. Each of these devices are well known in the art.

The user interface 63 can include any number of different components that are capable of accepting a user input so as to transition the plate 40 into the retracted position, in order to allow a user access to the firearm safety mechanism. In the preferred embodiment, the user interface can include or control a biometric authentication unit such as a fingerprint sensor 63*a*, for example that can be located anywhere along the outside facing surface of the grip 30.

As will be known to those of skill in the art, a biometric authentication unit may record the fingerprint of the user and store the image of the fingerprint in the memory 62. As such, upon recognition of the users fingerprint applied to the sensor 63*a*, the processor can instruct the latch to disengage the strikers 41, thereby retracting the plate 40. Of course, the user interface is not limited to the use of a biometric sensor, as any number of other known systems for receiving and/or verifying a user input are also contemplated. Several non-limiting examples include the use of an electromechanical combination lock system and/or a purely mechanical lock using a combination of numbers and/or letters, for example.

The internal component interface unit 64 can function to provide a communicative link between the processor 61 and various other device components such as the linear actuators 56, the sensor 63*a*, and/or the charging port 66*a*, for example. In this regard, the component interface unit can include any number of different components such as one or more PIC microcontrollers, internal bus, USB connections and other such hardware capable of providing a direct link between the various components. Of course any other means for providing the two way communication between the device components can also be utilized herein.

The communication unit 65 can include any number of devices capable of communicating with an external device either directly or over a network. In one preferred embodiment, the communication unit can include Bluetooth transceiver for communicating wirelessly with an external device such as a smartphone, computer and/or tablet device running an App. However, any number of other known transmission and reception mechanisms and protocols can also be utilized herein, several nonlimiting examples include unique radio frequencies, infrared (IR), RFID, and/or a network adapter functioning to communicate over a WAN, LAN or the internet via an internet service provided.

In this regard, the communication unit may be configured to notify an unsuspecting firearm owner of information such as, for example, a successful retraction of the panel, physical tampering of unit, a low battery charge status, and/or unsuccessful attempts to unlock the system e.g., unrecognized fingerprints, or entry of an incorrect authorization code. Such a feature can provide an additional layer of safety.

In one preferred embodiment, the power source 66 can include one or more DC batteries capable of providing the necessary power requirements to each element of the device 10. In one embodiment, the batteries can be permanently located within the main body and can be rechargeable in nature via a charging port 66*a*, such as a mini or micro USB port, for example. Of course, traditional batteries can also be utilized and the main body can further include a battery compartment having a removable cover (not illustrated) for allowing a user to access the same.

Figure 7A:
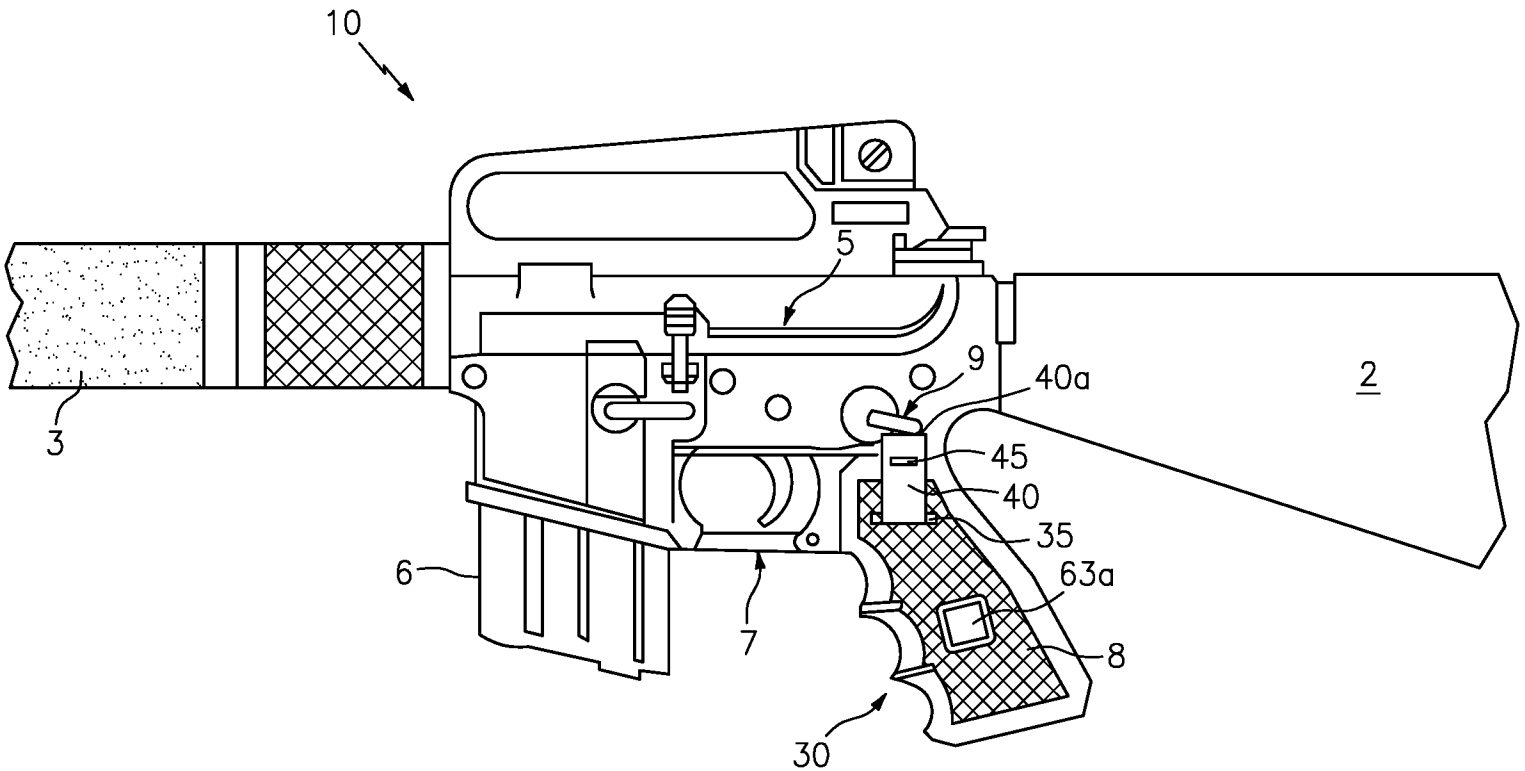
FIG. 7A is a side view of the firearm handgrip with integrated safety lock system in the extended position, in accordance with one embodiment of the invention.
Figure 7B:
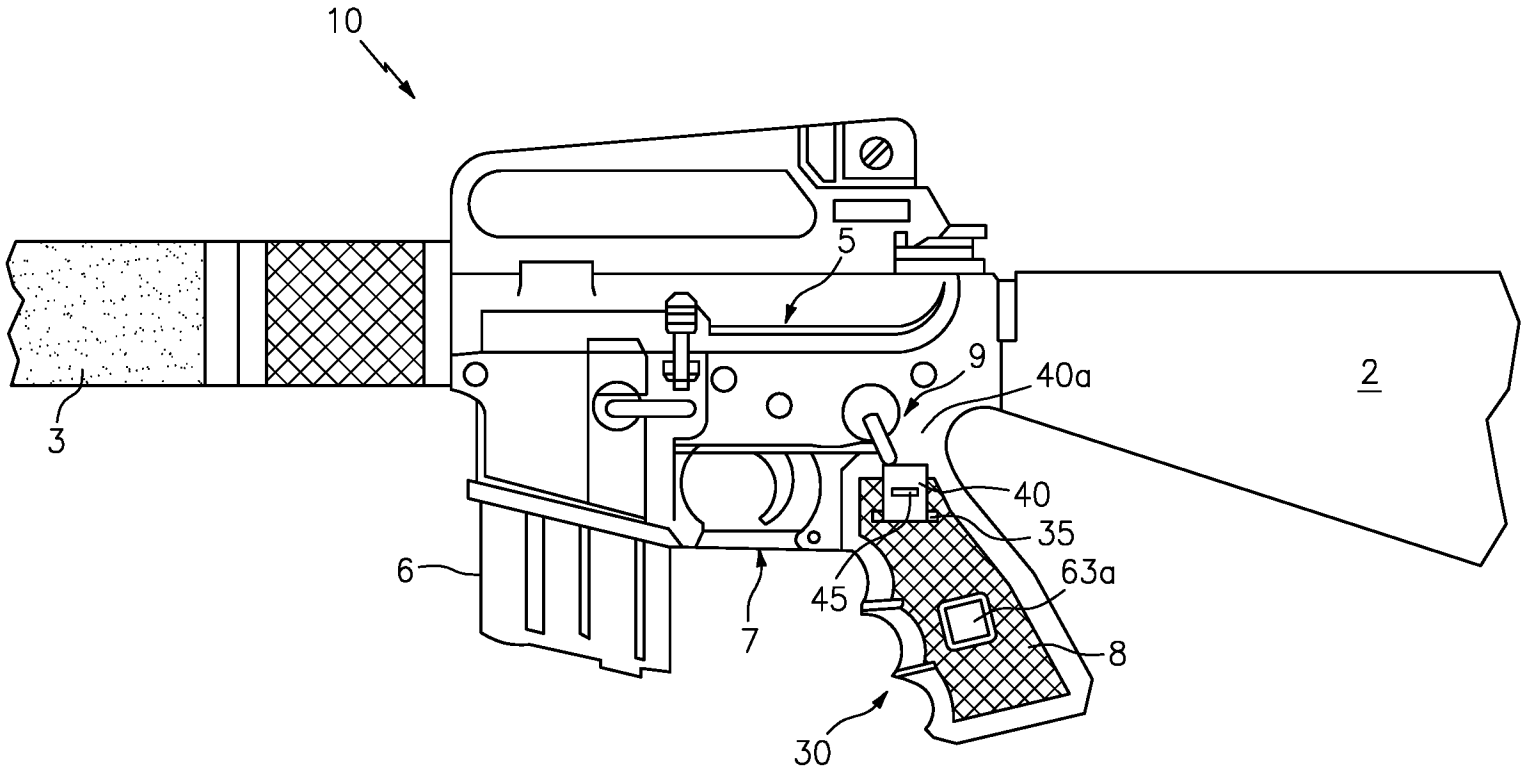
FIG. 7B is a side view of the firearm handgrip with integrated safety lock system in the retracted position, in accordance with one embodiment of the invention.

FIGS. 7A and 7B illustrate one embodiment of the system 10 in the extended and retracted positions, respectively. As noted above, the system 10 can function to replace the manufacturer-supplied grip of any type of firearm 1. As such, the grip 30 can be secured onto the same utilizing the manufacturer-supplied hardware, at which time the aperture 35 will be located directly beneath the selector/safety 9.

In operation, a user can impart an upward force onto the plate 40 via the thumb grip 45, for example, until the strikers 31 are engaged by the latches 55, as described above. At this time, the top surface of the plate 40*c* can be located adjacent to and/or be in contact with the bottom end of the selector/safety 9. When so located, the switch 9 will be locked in the horizontal "safe" position and the firearm will be unable to be fired.

When an authorized user wishes to fire the weapon, he or she can manipulate the user interface, such as the fingerprint sensor 63*a*, for example. Upon successful verification of the user's identity the internal controller can instruct the plate alignment unit to unlock the latches at which time the plate 40 will be immediately retracted, thereby providing the user with access to the firearm safety.

Although described above as including a plate alignment unit 50 having a retention member to maintain the device in the retracted position until/unless a user manually extends the plate 40, other embodiments are also contemplated. To this end, FIGS. 8A and 8B illustrate an alternate embodiment of the firearm handgrip with integrated safety lock system 10, having a plate alignment unit that functions to maintain the device in the extended position until/unless a user manually retracts the plate 40.

As shown, the plate alignment unit includes the above described opposing channels 51 and 52, the mounting panel 53, latches 55 and electromechanical component 56, described above. The unit can also include another retention member 54' and a mechanical latch 81, such as a spring loaded latch, for example, having an angled end 81*a* and a switch 82 that is located along the outside portion of the grip 30.

In the present embodiment, the retention member 54' can be positioned along the panel 53 at a location above the channels 51 and 52, and can also be connected to the bottom end of the plate 40*d*. In this regard, the retention member 54' functions to automatically position the retractable plate 40 in the extended position wherein the plate is automatically engaged by the latches 55, and with sufficient force to result in the firearm's safety/selector 8 being switched from the "fire" to "safe" without the need for manual rotation of the safety.

When an authorized user wishes to fire the weapon, he or she can manipulate the user interface as described above to release the latches 55. At this time, the user can impart a downward force onto the plate 40 via the thumb grip 45, for example, until one of the strikers 31 are engaged by the mechanical latch 81. The latch 81 can retain the plate 40 in the retracted position until the button 82 is depressed, at which time the retention member 54 will automatically return the plate 40 to the fully extended and locked position.

Such a feature therefore requires positive force to be applied to retract the latch from the fully extended state in which the plate is engaged along the underside of the firearm's safety lever. This positive force can ensure that the default state of the system results in the "safe" mode of the weapon rather than in the "fire" mode.

Accordingly, the above described firearm handgrip with integrated safety lock system provides an innovative safety solution that can be permanently mounted onto a firearm in order to secure the same in a locked state.

As described herein, one or more elements of the system 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individually identified elements such as the grip 30, the plate 40, and/or the plate alignment unit 50, for example, may be formed together as one or more continuous elements, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the terms "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. A handgrip lock system for use on a firearm having a safety mechanism, said system comprising:

a handgrip that includes an elongated member having a top end, an outside surface, an interior space and an aperture;

a plate having a top end, a bottom end, and an outside facing surface, a portion of said plate being positioned so as to extend through the aperture;

a plate alignment unit that is in communication with the plate, said alignment unit being disposed within the interior space of the handgrip and being configured to transition the plate between an extended position and a retracted position; and at least one connector that is disposed along the handgrip at a location suitable for mating with a complementary connector of the firearm so as to position the plate at a location adjacent to the firearm safety mechanism, wherein when the plate is in the extended position, the top end of the plate is in direct contact with the firearm safety mechanism.

2. The system of claim 1, wherein the plate alignment unit includes a latch that is configured to selectively lock the plate in the extended position.

3. The system of claim 2, wherein the plate alignment unit further includes a retention member that maintains the plate in the retracted position.

4. The system of claim 3, further comprising:

a thumb grip that is positioned along the outside facing surface of the plate and is configured to receive a manual force to transition the plate from the retracted position to the extended position.

5. The system of claim 2, wherein the plate alignment unit further includes a retention member that maintains the plate in the extended position.

6. The system of claim 5, further comprising:

a thumb grip that is positioned along the outside facing surface of the plate and is configured to receive a manual force to transition the plate from the extended position to the retracted position.

7. The system of claim 2, further comprising:

a user interface that is configured to receive a user instruction to transition the plate between the extended position and the retracted position.

8. The system of claim 7, further comprising:

an internal controller that is in communication with, and controls an operation of each of the user interface and the plate alignment unit.

9. The system of claim 8, wherein the user interface includes a biometric authentication unit; and the internal controller includes a memory that is configured to store and retrieve biometric information and system operation information.

10. The system of claim 9, further comprising:

a communication unit that is configured to send and receive system information with an external device.

11. The system of claim 1, wherein each of the plate and the plate alignment unit are constructed from a hardened impact resistant material.

12. The system of claim 1, wherein the plate alignment unit includes a pair of channels each having a top end, a bottom end and an elongated opening extending therebetween.

13. The system of claim 12, wherein the plate further includes a pair of strikers that extend outward therefrom, each of said strikers being positioned within one of the elongated openings of the pair of channels and functioning to travel between the top ends and the bottom ends thereof.

14. The system of claim 13, further comprising:

a pair of upper latches that are disposed along the top ends of the pair of channels, said upper latches including an internal locking mechanism that is configured to engage the strikers and secure the plate in the extended position.

15. The system of claim 14, further comprising:

an electromechanical component that is in communication with the pair of upper latches and is configured to disengage the upper latches from the strikers; and a first user interface that is in communication with, and controls an operation of the electromechanical component.

16. The system of claim 15, further comprising:

a retention member that imparts a constant force onto the plate in a direction toward the bottom ends of the channels that maintains the plate in the retracted position.

17. The system of claim 15, further comprising:

a retention member that imparts a constant force onto the plate in a direction toward the upper ends of the channels that maintains the plate in the extended position.

18. The system of claim 17, further comprising:

a lower latch that is positioned along the bottom end of one of the pair of channels, said lower latch including an internal locking mechanism that is configured to engage one of the strikers and secure the plate in the retracted position.

19. The system of claim 18, further comprising:

a second user interface that is in communication with, and controls an operation of the lower latch.

20. The system of claim 19, wherein the first user interface includes a biometric authentication unit, and the second user interface includes a mechanical button.

* * * * *